US005915763A

United States Patent [19]

Masuda

[11] Patent Number: 5,915,763

[45] Date of Patent: Jun. 29, 1999

[54] ORIFICE PLATE AND AN INK JET RECORDING HEAD HAVING THE ORIFICE PLATE

[75] Inventor: Kazuaki Masuda, Sagamihara, Japan

[73] Assignee: Canon Kabushiki Kaisha, Tokyo, Japan

[21] Appl. No.: 08/390,813

[22] Filed: Feb. 16, 1995

Related U.S. Application Data

[63] Continuation of application No. 07/875,602, Apr. 28, 1992, abandoned, which is a continuation of application No. 07/358,464, May 30, 1989, abandoned, which is a continuation of application No. 07/120,685, Nov. 9, 1987, abandoned, which is a continuation of application No. 06/804,109, Dec. 3, 1985, abandoned.

[30] Foreign Application Priority Data

Dec. 6, 1984 [JP] Japan ..... 59-257966

[51] Int. Cl.[6] ..... B41J 2/16

[52] U.S. Cl. ..... 29/890.1; 216/27; 347/47; 347/63

[58] Field of Search ..... 347/44, 47, 54, 347/56, 63, 65; 430/320, 321, 327; 29/890.1; 216/27

[56] References Cited

U.S. PATENT DOCUMENTS

| | | | |
|---|---|---|---|
| 4,211,617 | 7/1980 | Hunyar | 205/68 |
| 4,277,548 | 7/1981 | Vedder | 156/668 |
| 4,302,268 | 11/1981 | Tachiki et al. | 156/238 |
| 4,434,430 | 2/1984 | Koto | 347/70 |
| 4,437,100 | 3/1984 | Sugitani et al. | 347/65 |
| 4,490,728 | 12/1984 | Vaught et al. | 347/60 |
| 4,558,333 | 12/1985 | Sugitani et al. | 347/65 |
| 4,568,953 | 2/1986 | Aoki et al. | 347/65 |
| 4,583,866 | 4/1986 | Kasai et al. | 430/320 X |
| 4,611,219 | 9/1986 | Sugtani et al. | 347/56 X |

FOREIGN PATENT DOCUMENTS

| | | | |
|---|---|---|---|
| 55-118877 | 9/1980 | Japan | B41J 3/04 |
| 61-37439 | 2/1982 | Japan | B41J 3/04 |

*Primary Examiner*—Joseph Hartary
*Attorney, Agent, or Firm*—Fitzpatrick, Cella, Harper & Scinto

[57] ABSTRACT

An orifice plate having an orifice(s) for liquid ejection is produced by supplying a photosensitive resin to a mold having projections and recesses, curing the photosensitive resin, and releasing the cured resin shaped member from the mold.

An orifice plate shaped by means of a mold comprises an orifice(s) for ejecting a liquid and projections forming walls of liquid flow path(s) through which the liquid is supplied to and communicates with the orifice, the material constituting the orifice plate being a cured resin produced by curing a photosensitive resin.

6 Claims, 7 Drawing Sheets

ORIFICE PLATE AND AN INK JET RECORDING HEAD HAVING THE ORIFICE PLATE

This application is a continuation of application Ser. No. 07/875,602 filed Apr. 28, 1992, now abandoned, which was a continuation of application Ser. No. 07/358,464 filed May 30, 1989, now abandoned, which was a continuation of application Ser. No. 07/120,685 filed Nov. 9, 1987, now abandoned, which was a continuation of application Ser. No. 06/804,109 filed Dec. 3, 1985, now abandoned.

BACKGROUND OF THE INVENTION

1. Field of the Invention

This invention relates to an orifice plate for an ink jet recording head, a method for producing the orifice plate, and an ink jet recording head provided with the orifice plate.

2. Description of the Prior Art

Non-impact recording methods generate only a small noise which is negligible upon recording so that the methods have recently drawn attentions. Among them, ink jet recording methods (liquid jet recording methods) by which a high speed recording is possible and full color recording can be effected on plain paper without a special treatment, i.e. fixation are very powerful recording methods, and heretofore, various types of ink jet recording methods have been proposed and some of them have been already commercially used while some are now under development.

In such liquid jet recording methods, so-called ink, a recording liquid, is propelled in a form of a droplet and attached to a receiving member to effect recording. The liquid jet recording methods are classified into various types depending upon the method for forming droplets of the recording liquid and the method for controlling the propelling direction of the droplets thus formed.

Among them, U.S. Pat. Nos. 3,683,212, 3,747,120, 3,946, 398 etc. disclose liquid jet recording methods, so-called drop-on-demand recording methods, where the recording liquid is ejected and propelled in the form of a droplet through ejection orifices and the droplets are attached to the surface of a receiving member to record. According to said recording methods, the amount of the recording liquid to be ejected is that required for recording only so that it is not necessary to recover any ejected recording liquid not required for recording and provide with any particular means for treating such unnecessarily ejected droplets. In addition, the recording apparatus can be simplified and miniaturized, and it is not necessary to control the propelling direction of droplets of the recording liquid ejected through the ejection orifice. Furthermore, multicolor recording can be easily effected and the like. In view of the foregoing, the recording methods have recently drawn attentions to a great extent.

Japanese Patent Application Laid-open No. 51837/1979, West German Laid-open (DOLS) No. 2843064, U.S. Pat. No. 4,492,966 and U.S. Pat. No. 4,410,899 disclose liquid jet recording methods completely different from the above-mentioned liquid jet recording method in point of the principle as to the formation of droplets to be propelled. However, the liquid jet recording methods disclosed in the above-mentioned patent documents can be not only very effectively applied to the drop-on-demand recording methods, but also can be easily realized in a recording head of multi-orifice type of high density, and therefore, the methods can produce recorded images of high resolution and high quality at a high speed.

The liquid jet recording apparatus used for the drop-on-demand recording method is usually constituted of a recording head having orifices for ejecting a recording liquid in the form of a droplet, liquid flow paths communicating with the respective orifices and having ejection energy generating elements for producing droplets to be propelled and liquid chambers communicating with the liquid flow paths for storing the recording liquid to be supplied to the liquid flow paths, and the recording head being fixed to a carriage capable of scanning relatively over a receiving member.

In the following, referring to the drawing, a conventional method for fabricating orifice plates and the structure of conventional orifice plates will be explained briefly by using steps for fabricating ink jet recording heads.

FIG. 1 is a schematic oblique view of a substrate having ejection energy generating elements of a prior art ink jet recording head. A substrate 6 as a support composed of glass, ceramics, plastics, metal or the like having an ink supplying port 8 is fitted with ejection energy generating elements 7. Electrodes for output of record signal (not shown) are connected with the ejection energy generating elements 7. If necessary, for the purpose of protecting the ejection energy generating elements 7 and the electrodes from electrolytic corrosion caused by contacting the ink, there is provided a protecting layer.

FIG. 2 is a schematic oblique view of the substrate of a prior art ink jet recording head in FIG. 1 additionally provided with liquid flow path walls and an outer frame. In FIG. 2, liquid flow path walls 4 for forming liquid flow paths and an outer frame 5 are mounted on the substrate 6 obtained in FIG. 1.

FIG. 3(*a*) is a schematic oblique view of an orifice plate having ejecting orifices of a prior art ink jet recording head, and FIG. 3(*b*) is a schematic cross section taken along the dot-and-dash line in FIG. 3(*a*).

In FIG. 3(*a*) and FIG. 3(*b*), an orifice plate 1 is provided with ejection orifices 2. An adhesive is applied to the outer side regions of orifice plate 1 and then the orifice plate 1 is adhered to substrate 6 obtained in FIG. 2 to complete an ink jet recording head. The completed ink jet recording head is shown in FIG. 4(*a*) (oblique view) in which 9 denotes the adhesive. FIG. 4(*b*) is a schematic cross sectional view taken along a dot-and-dash line C-C' in FIG. 4(*a*). The reference numerals similar to those in FIGS. 1–3 denote the similar parts, respectively.

As a material for the orifice plate 1, there may be generally used metal, glass, ceramics, plastics and the like.

However, according to the above-mentioned prior art method for producing ink jet recording heads, the step for forming liquid flow path walls 4 and outer frame 5 and the step for forming orifice plate 1 are separately carried out so that the number of steps is larger and the number of parts increases. As the result, the cost for production is disadvantageously raised. As a method for forming orifices, there are, for example, the following methods, accompanied with the following drawbacks.

(1) Mechanical processing is liable to cause cracking and form burrs. Therefore, it is difficult to obtain a head of good ejection performance. In order to obtain records of high quality, it is required to make the ejection orifice diameter small, arrange the orifices densely, and make multi-orifices, but these can be attained only to a limited extent when ejection orifices are fabricated by mechanical processing.

(2) When etching is used for fabricating the head, it is desirable to effect etching from both sides of a plate so as to enhance the accuracy of the diameter of the ejection orifice. Therefore, the number of steps increases resulting in high cost.

(3) On an appropriate metal plate is formed a pattern of ejection orifices by using a hardened film of a photosensitive resin, and then, nickel or other metal plating is applied by an electrolytic or a non-electrolytic plating method. The cured film of the photosensitive resin and the metal plate are removed to obtain a plating film having the ejection orifices.

The above-mentioned method has many steps and moreover, it takes a considerably long time in order to obtain the thickness of about 0.1 mm required for necessary strength by means of plating only. As a result, the cost becomes expensive.

For the purpose of eliminating the above-mentioned drawbacks, there have been proposed methods comprising simultaneously integrating liquid flow path walls and orifices. That is, (1) Japanese Patent Application Laid-open No. 118469/1984 discloses a method comprising producing a pattern for forming orifices on a mold having projections and recesses for forming liquid flow path walls and liquid chambers by using a photosensitive resin, applying metal plating to the projections and recesses and patterns for forming orifices, and finally, releasing the plating film from said mold to obtain an orifice plate. The flow sheet of this method is shown in FIG. 5. In addition, (2) there is another method for fabricating an orifice plate comprising integrally shaping orifices, liquid flow path walls and recesses for forming liquid chambers with a resin by using a shaping method such as accurate injection molding, compression molding, transfer molding and the like.

However, the above-mentioned improving methods have the following disadvantages.

The method in (1) above can attain high accuracy, but it requires many steps as shown in FIG. 5 and therefore, the cost can not be so low. In addition, since the metal plating is applied to a considerable thickness, it takes a long time to effect the plating. The waste liquor from the metal plating should be treated so as to avoid possible water pollution. This treatment requires a large capital investment.

The method (2) can provide good mass production as to shaping and therefore, orifice plates of a considerably low cost can be obtained, but the resin shaping can not give orifice plates of a high accuracy (tolerance being several microns or so) and a high density (at least 4 orifices/mm).

In view of the foregoing, inexpensive and highly accurate orifice plates are not available at present.

SUMMARY OF THE INVENTION

An object of the present invention is to solve the above-mentioned problems.

Another object of the present invention is to provide an orifice plate of high accuracy and low cost, a method for producing the orifice plate and an ink jet recording head having the orifice plate.

According to one aspect of the present invention, there is provided a method for producing an orifice plate having at least one orifice for liquid ejection which comprises the steps:

(a) supplying a photosensitive resin to a mold region including a recess portion of a mold for the orifice plate having projections and recesses, (b) curing the photosensitive resin thus supplied to form a cured resin shaped member, and (c) releasing the cured resin shaped member from the mold.

According to another aspect of the present invention, there is provided an orifice plate shaped by means of a mold which comprises at least one orifice for ejecting a liquid and projections forming walls of at least one liquid flow path which the liquid is supplied to and communicates with the orifice, and the material constituting the orifice plate being a cured resin produced by curing a photosensitive resin.

According to a further aspect of the present invention, there is provided an ink jet recording head which comprises an orifice plate shaped by means of a mold comprising at least one orifice for ejecting a liquid and projections forming walls of at least one liquid flow path which the liquid is supplied to and communicates with the orifice, the material constituting the orifice plate being a cured resin produced by curing a photosensitive resin, and a substrate having at least one ejection energy generation element for ejecting the liquid, the liquid flow path being formed by the orifice plate and the substrate.

BRIEF DESCRIPTION OF THE DRAWINGS

FIG. 3(*b*) is a schematic cross section of FIG. 3(*a*) taken along the dot-and-dash line;

FIG. 4(*b*) is a schematic cross section taken along dot-and-dash line C-C' in FIG. 4(*a*);

FIG. 6(*b*) and FIG. 6(*c*) are schematic cross sectional views taken along dot-and-dash lines A-A' and B-B' in FIG. 6(*a*), respectively;

FIG. 7(*b*) and FIG. 7(*c*) are schematic cross sectional views of FIG. 7(*a*) taken along dot-and-dash lines A-A' and B-B', respectively;

FIG. 8(*b*) and FIG. 8(*c*) are schematic cross sectional views of FIG. 8(*a*) taken along dot-and-dash lines A-A' and B-B', respectively;

FIG. 9(*b*) and FIG. 9(*c*) are schematic cross sectional views of FIG. 9(*a*) taken along dot-and-dash lines A-A' and B-B', respectively.

DESCRIPTION OF THE PREFERRED EMBODIMENTS

The present invention will be explained below in detail referring to preferred embodiments.

Figure 6A:
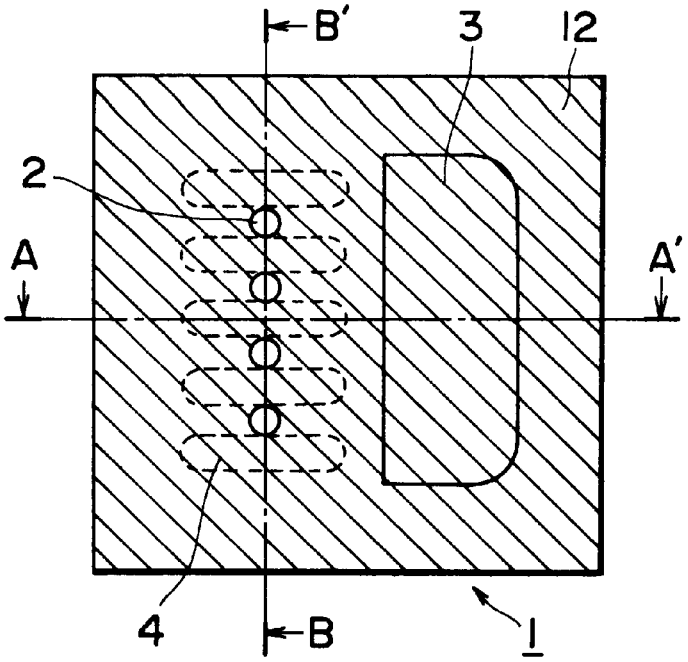
FIG. 6(*a*) is a schematic top view of an orifice plate of an ink jet recording head according to the present invention.
Figure 6B:
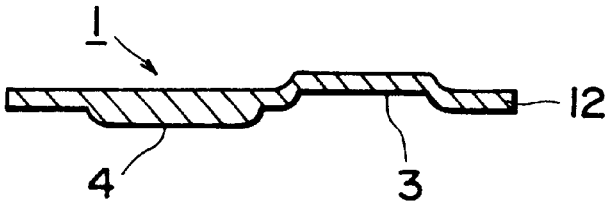
Figure 6C:
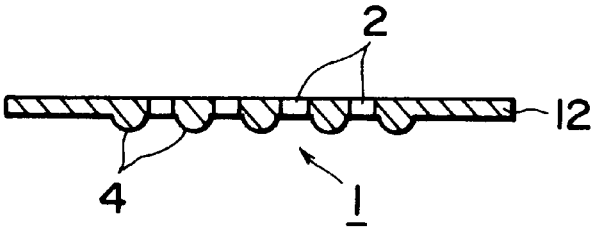

FIG. 6(*a*) is a schematic top view of an orifice plate prepared according to the present invention. FIG. 6(*b*) and FIG. 6(*c*) are cross sectional views taken along dot-and-dash lines A-A' and B-B', respectively, in FIG. 6(*a*). 2 denotes an orifice, 3 a recess for forming a liquid chamber and 4 a liquid flow path wall. An orifice plate 1 is composed of a photosensitive resin 12. The orifice plate 1 may be produced as shown below.

Figure 7A:
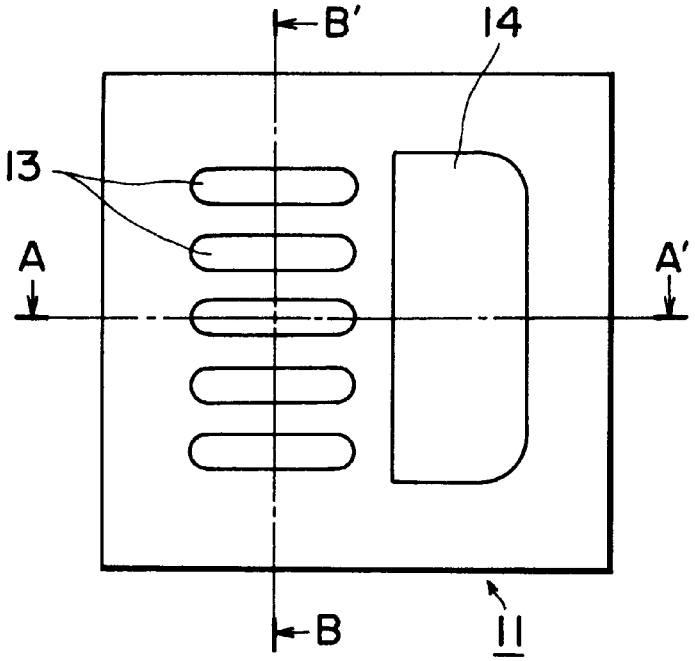
FIG. 7(*a*) is a schematic top view of a mold for forming an orifice plate of the present invention.
Figure 7B:
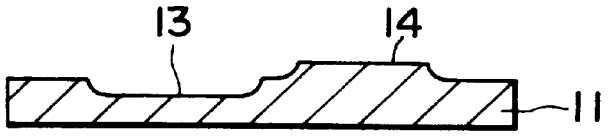
Figure 7C:
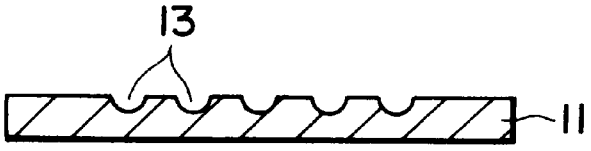

A mold of stainless steel (for example, SUS 304) as shown in FIGS. 7(*a*)–7(*c*) is produced by a known photolithoetching process. FIG. 7(*a*) is a schematic top view of a mold used for producing an orifice plate according to the present invention. FIG. 7(*b*) and FIG. 7(*c*) are schematic cross sectional views taken along dot-and-dash lines A-A' and B-B', respectively, in FIG. 7(*a*).

Figure 8A:
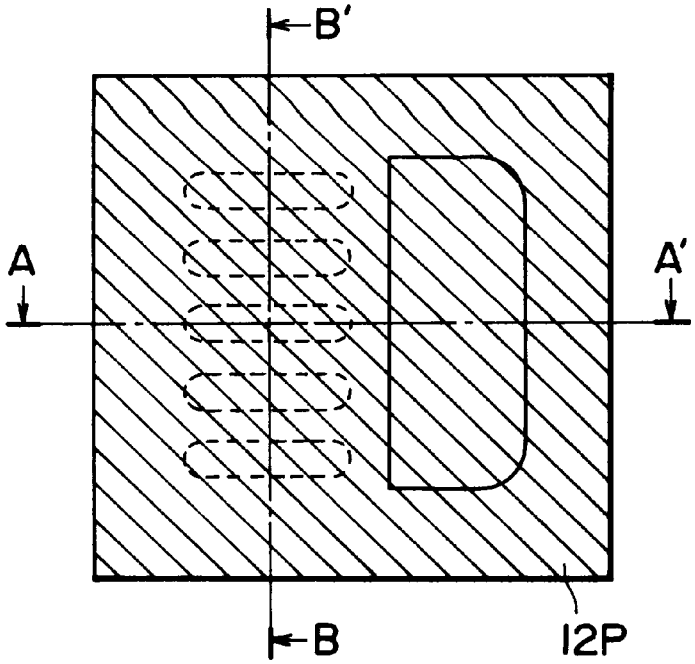
FIG. 8(*a*) is a schematic top view of an assembly constituted of the mold in FIG. 7 and a photosensitive resin layer overlying the mold according to the present invention.
Figure 8B:
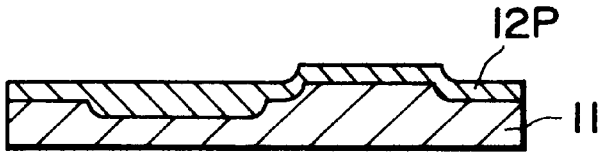
Figure 8C:
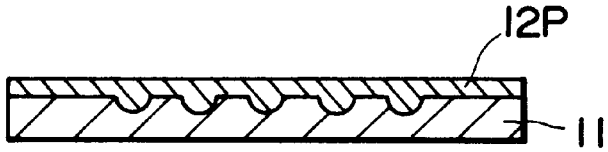
Figure 9A:
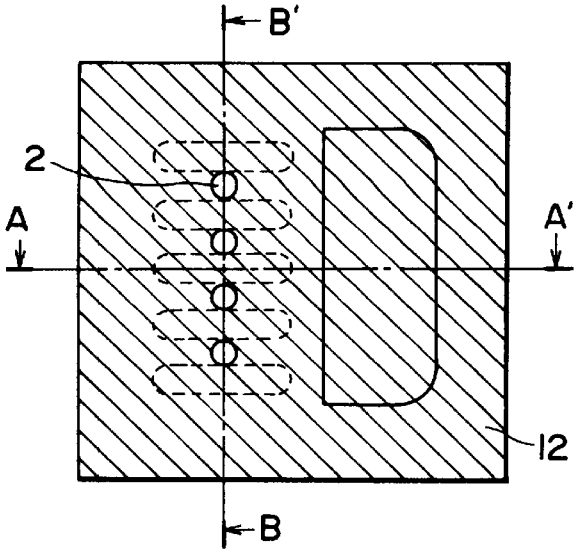
FIG. 9(*a*) is a schematic top view of an assembly in FIG. 8 in which ejection orifices are formed in the photosensitive resin layer.
Figure 9B:
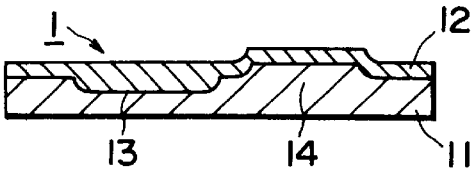
Figure 9C:
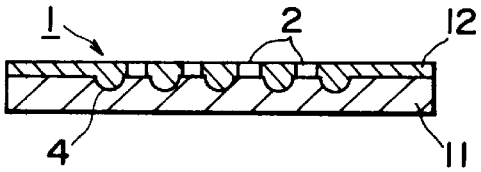

Groove portions 13 for forming liquid flow path walls and a projection 14 are formed by etching using an aqueous ferric chloride. After forming the mold, a releasing agent, for example, a compound containing fluorine such as polytetrafluoroethylene or a silicon compound such as silicone oil, is applied to the surface of the mold by using a spray. This treatment with a releasing agent is made so as to facilitate the releasing of the cured photosensitive resin from the mold at the end of the steps. Then, a photosensitive resin layer 12P is formed on a mold 11 as shown in FIG. 8(*a*)–FIG. 8(*c*). FIG. 8(*a*) is the schematic top view, and FIG. 8(*b*) and FIG. 8(*c*) are schematic cross sectional views taken along dot-and-dash lines A-A' and B-B', respectively, in FIG. 8(*a*). For example, a photosensitive resin film is laminated on a mold, and at that time, the photosensitive resin is applied to a mold region including a recess portion, if desired, additionally including a projection portion, for example, the projection and recess portions of mold 11 by the pressure of the laminater and heat to transfer the projections and recess to the photosensitive resin. With respect to recess portions, air is liable to remain there so that a vacuum laminater is preferably used. The thickness of photosensitive layer 12P is about 50–100$\mu$. FIG. 9(*a*) is a schematic top view of an assembly in FIG. 8 in which ejection orifices are formed in the photosensitive resin layer, and FIG. 9(*b*) and FIG. 9(*c*) are schematic cross sectional views of FIG. 9(*a*) taken along dot-and-dash lines A-A' and B-B', respectively. A photomask for forming orifices is placed on a photosensitive resin layer 12P, and according to an ordinary photolithographic process, exposure and development are effected and the photosensitive resin at the orifice portions is dissolved and removed to form the orifices. Then, irradiation with ultraviolet ray and/or heating cures completely the photosensitive resin to produce a cured resin shaped member followed by peeling or releasing from the mold. The orifice plate 1 formed by using a cured film 12 of the photosensitive resin according to the present invention is shown in FIG. 6.

Figure 10:
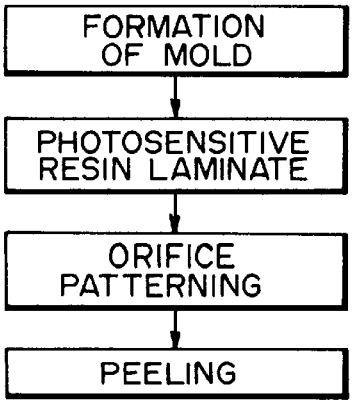
FIG. 10 is a flow sheet showing the steps for fabricating an orifice plate according to the present invention.

The above-mentioned method for producing an orifice plate is shown in FIG. 10 by a flow sheet.

Figure 5:
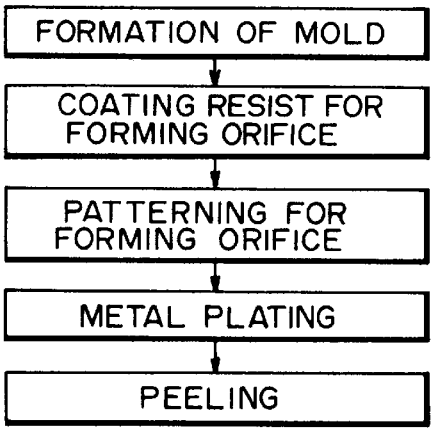
FIG. 5 PRIOR ART
FIG. 5 is a flow sheet showing the steps for fabricating an orifice plate of a prior art ink jet recording head.

According to the method of the present invention, different from the prior art as shown in FIG. 5, the cured film of the photosensitive resin is directly used as the orifice plate material so that a metal plating step is omitted and there are eliminated large drawbacks due to employing metal plating, that is, the long time necessary for obtaining the thickness of metal plating having a required mechanical strength and the capital investment for the plating apparatus and the related waste water treatment plant are unnecessary. As a result, the production cost of orifice plates can be decreased to a great extent. With respect to accuracy, the method of the present invention can produce an orifice plate of a sufficiently high accuracy as compared with a mechanical processing or injection, compression, or transfer shaping of resin.

Table 1 shows examples of photosensitive resins used, accuracy of orifice diameter of the orifice plates produced according to the present invention. As is clear from Table 1, the accuracy is within about ±5$\mu$ and is sufficiently satisfactory to the performance of recording of the ink jet recording head.

TABLE 1

| Photosensitive resin (Tradename) | Orifice diameter (Designed value) | Fluctuation of measured value of the orifice diameter |
|---|---|---|
| Photec SR-3000 produced by Hitachi Kasei K.K. | 50 $\mu$ | ±4 $\mu$ |
| VACREL 930 produced by Du Pont | 70 $\mu$ | ±5 $\mu$ |
| Thiokol LAMINAR GL produced by Tokyo Ohka K.K. | 50 $\mu$ | ±4 $\mu$ |

In the examples in Table 1 above, the resins are all photosensitive resins of acrylic type, but according to the present invention, any photosensitive resins may be used without being limited to acrylic resins. For example, there may be used diazo resin, p-diazo-quinone, photopolymerization type photopolymers using, for example, a vinyl monomer and a polymerization initiator, dimerization type photopolymers using polyvinyl cinnamate, etc., and a sensitizing agent, a mixture of o-napthoquinone diazide and a Navolac type phenolic resin, a mixture of polyvinyl alcohol and a diazo resin, polyether type photopolymers obtained by copolymerization of 4-glycidylethylene oxide with benzophenone, glycidylchalcone or the like, copolymer of N,N-dimethylmethacryl amide and, for example, acrylamide benzophenone, unsaturated polyester type photosensitive resins such as APR (tradename, produced by Asahi Kasei Kogyo K.K.), TEBISTA (tradename, produced by Teijin K.K.), Sonne (tradename, produced by Kansai Paint K.K.) and the like, unsaturated urethane oligomer type photosensitive resins, photosensitive compositions composed of a photopolymerization initiator, a polymer and a bifunctional acryl monomer, dichromate type photo-resists, non-chromium type water-soluble photo-resists, polyvinyl cinnamate type photoresists, cyclized rubber-azide type photoresists and the like.

As a solid photosensitive resin of a film type, there may be used Permanent Photopolymer Coating "RISTON", Solder Mask 730S, Solder Mask 740S, Solder Mask 730FR, Solder Mask 740FR, Solder Mask SM1, KAPTON, XA - A3, XA - B3, XA - A1, XA - M3, and XA - C3 (tradenames, produced by Du Pont), Photec, PHT series, Photec SR series (tradenames, produced by Hitachi Kasei K.K.), DFR, E - 15, P - 25, P 38, T - 50 (tradenames, produced by Asahi Kasei K.K.), NEOTPOCK, E type, NEOTPOCK, T type (tradenames, produced by Nitto Denko), Thiokol Laminar CT, Thiokol Laminar GSL, Thiokol Laminar $TO_i$, Thiokol Laminar TA (tradenames, produced by Tokyo Ohka K.K.) and the like.

In the above, a photosensitive resin is applied to the mold such that a film-like resin is set to the mold, but there may be used other methods such as coating a mold with a liquid photosensitive resin by a spinner, printing a photosensitive resin to a mold, a dipping method, and the like.

However, for the purpose of obtaining a photosensitive resin layer of a uniform thickness and covering sufficiently the projection and recess of mold 11 without any defect of coating, it is preferable to use a photosensitive resin in the form of a film and laminate the mold with the photosensitive resin film.

In the example of the present invention as above, the orifice plate is provided with four ejection orifices, but the number of ejection orifice may be one or more.

The arrangement of ejection orifices may be varied optionally depending upon the design of the ink jet recording head. For example, the ejection orifices are arranged in one line, or zigzag.

Figure 1:
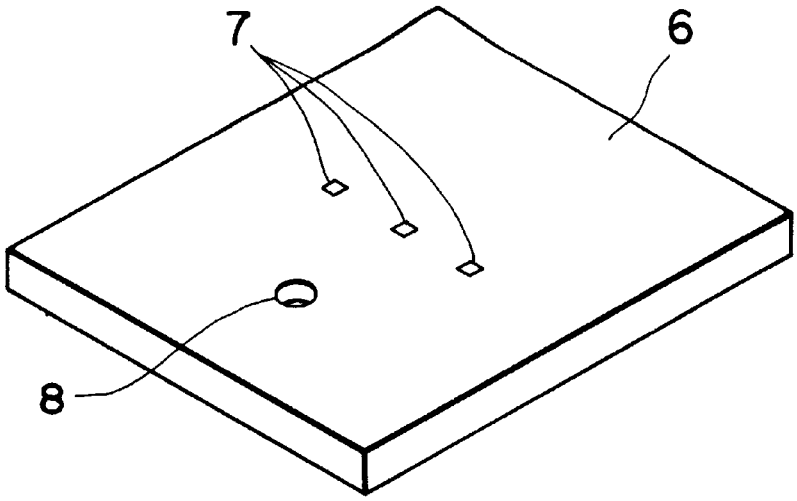
FIG. 1 PRIOR ART
FIG. 1 is a schematic oblique view of a substrate having ejection energy generating elements of a prior art ink jet recording head.
Figure 2:
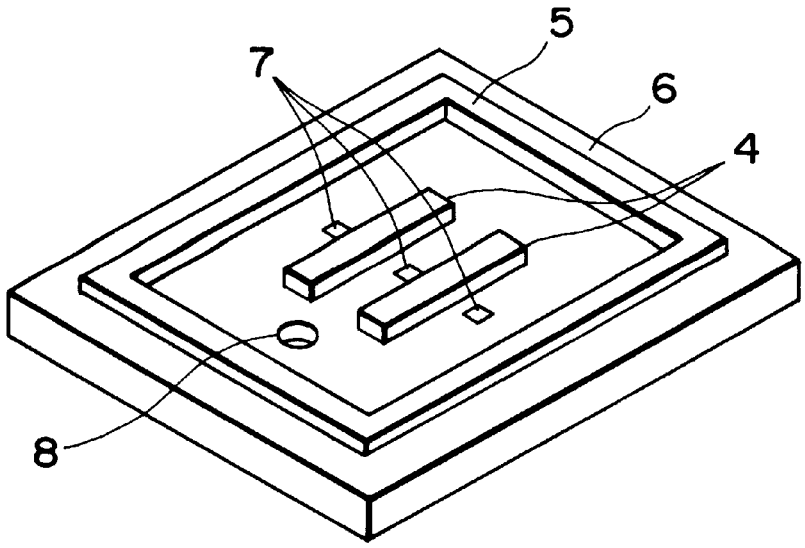
FIG. 2 PRIOR ART
FIG. 2 is a schematic oblique view of the substrate in FIG. 1 above which additionally have liquid flow path walls and an outer frame.
Figure 3A:
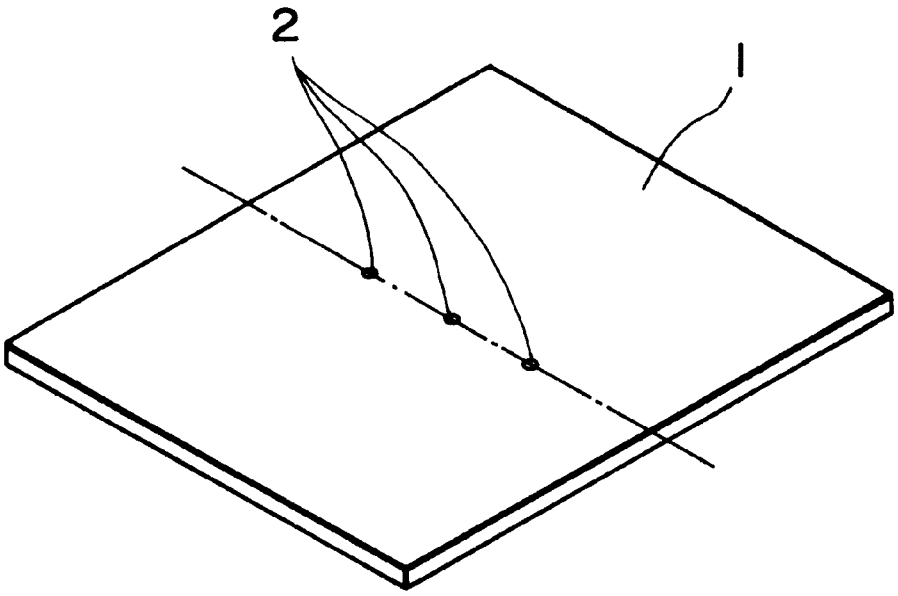
FIG. 3(a) PRIOR ART
FIG. 3(*a*) is a schematic oblique view of an orifice plate having ejection orifices of a prior art ink jet recording head.
Figure 3B:
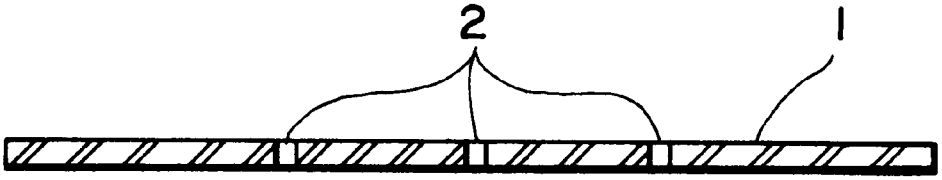
FIG. 3(b) PRIOR ART
Figure 4A:
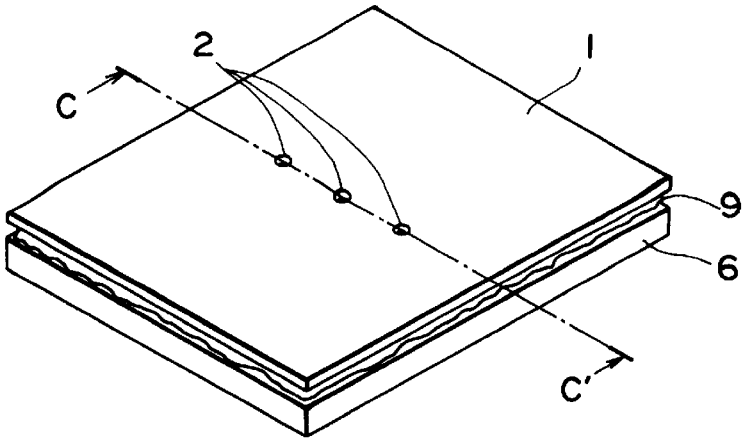
FIG. 4(a) PRIOR ART
FIG. 4(*a*) is a schematic oblique view of a prior art ink jet recording head.
Figure 4B:
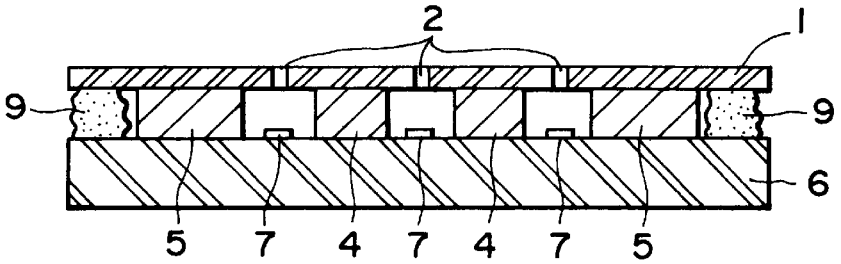
FIG. 4(b) PRIOR ART

An embodiment of the ink jet recording head according to the present invention can be produced by adhering the orifice plate of the present invention to a substrate having ejection energy generating elements as shown, for example, in FIG. 1.

As the ejection energy generating elements, there may be used an electromechanical transducer such as piezoelectric elements and the like as desclosed in the above-mentioned U.S. Pat. No. 3,946,398, and an electrothermal transducer such as heat generating elements and the like disclosed in U.S. Pat. No. 4,492,966.

According to the method of the present invention, the ejection orifices may be formed during the steps (a)–(c) or thereafter. In the above example, the orifices are formed by applying to the photosensitive resin the treatments, i.e. exposure and development. In addition, according to the present invention, orifices can be formed by providing the mold with projections for forming orifices, or orifices can be formed by mechanical processing before or after releasing the cured resin shaped member from the mold.

As described above in detail, the method for producing an orifice plate according to the present invention comprises the steps:

(a) supplying a photosensitive resin to a mold region including a recess portion of a mold for the orifice plate having projections and recesses, (b) curing the photosensitive resin thus supplied to form a cured resin shaped member, and (c) releasing the cured resin shaped member from the mold.

The orifice plate according to the present invention is shaped by means of a mold and comprises an orifice or orifices for ejecting a liquid and projections forming walls of liquid flow path(s) which the liquid is supplied to and communicates with the orifice, and the material constituting the orifice plate being a cured resin produced by curing a photosensitive resin.

Furthermore, the ink jet recording head according to the present invention comprises an orifice plate shaped by means of a mold comprising an orifice or orifices for ejecting a liquid and projections forming walls of one or more liquid flow paths which the liquid is supplied to and communicate with the orifice, the material constituting the orifice plate being a cured resin produced by curing a photosensitive resin, and a substrate having one or more ejection energy generation elements for ejecting the liquid, the liquid flow path being formed by the orifice plate and the substrate.

As described above, in case that the orifice plate is formed with a photosensitive resin utilizing the shapeability, it is not necessary to form separately an orifice plate and liquid flow paths as in prior art since orifices, liquid flow path walls and recess for a liquid chamber are integrally formed. Therefore, the production steps are simple and the orifice plate thus formed for an ink jet recording head is very inexpensive.

In particular, in the case where shapeability of a photosensitive resin is utilized to form liquid flow path walls and recess for a liquid chamber and photosensitivity of the photosensitive resin is utilized to form orifices, a photolithographic technique is used, as it is, for the orifice system affecting largely the fluctuation of recording performance of an ink jet recording head, and therefore, it is possible to effect the processing with an accuracy in the order of ± several microns. Therefore, orifice plates of satisfactory accuracy can be provided.

As the result, it is now possible to provide inexpensive and highly accurate orifice plates, and therefore, the production cost of ink jet recording heads can be lowered and further, since the accuracy is high, it is possible to provide recording heads of low fluctuation of recording quality and high reliability.

What is claimed is:

1. A process for producing an orifice member for use in an ink jet head having a plurality of discharge openings therethrough for discharging an ink, comprising the steps of:

providing a mold having a surface on which are formed a plurality of groove portions for forming a plurality of walls defining a plurality of flow paths and a projection portion for forming a concave portion defining a liquid chamber;

superposing a film of a photosensitive resin on the surface of the mold;

applying pressure and heat to the film to deform the film in conformity with a shape of the plurality of groove portions and the projection portion of the mold, thereby forming in the film the plurality of walls defining the plurality of flow paths and a recessed portion constituting the liquid chamber;

then effecting exposure with a masks developing the film in the mold as arranged on the mold to form a developed film member and removing an unexposed portion of the developed film member to form the plurality of discharge openings;

effecting a curing treatment for curing completely the developed film member; and releasing the film member that has been cured from the mold.

2. The process according to claim 1, further comprising the step of applying onto the surface of the mold a parting agent facilitating release of the film from the mold.

3. The process according to claim 1, wherein said step of laminating the film comprises using a vacuum laminator.

4. A process for producing an ink jet head for discharging an ink, comprising the steps of:

providing a mold having a surface on which are formed a plurality of groove portions for forming a plurality of walls defining a plurality of flow paths and a projection portion for forming a concave portion defining a liquid chamber;

superposing a film of a photosensitive resin on the surface of the mold;

applying pressure and heat to the film to deform the film in conformity with a shape of the plurality of groove portions and the projection portion of the mold, thereby forming in the film the plurality of walls defining the plurality of flow paths and a recessed portion constituting the liquid chamber;

then effecting exposure with a mask and developing the film as arranged on the mold to form the plurality of discharge openings;

effecting curing treatment for completely curing the developed film member; and releasing the film member that has been cured from the mold; and connecting the orifice member to a substrate having a plurality of discharge energy generation elements.

5. The process according to claim 4, further comprising the step of applying onto the surface of the mold a parting agent facilitating release of the film from the mold.

6. The process according to claim 4, wherein said step of laminating the film comprises using a vacuum laminator.

* * * * *

UNITED STATES PATENT AND TRADEMARK OFFICE

CERTIFICATE OF CORRECTION

PATENT NO. : 5,915,763

DATED : June 29, 1999

INVENTOR(S) : KAZUAKI MASUDA

It is certified that error appears in the above-identified patent and that said Letters Patent is hereby corrected as shown below:

On the title page,

AT [56] REFERENCES CITED

Under Foreign Patent Documents:

"61-37439 2/1982" should read --61-37439 2/1986--.

COLUMN 7

Line 2, "$TO_i$," should read --$TO_1$,--.

COLUMN 8

Line 49, "masks" should read --mask,--.

Signed and Sealed this

Fourteenth Day of March, 2000

*Attest:*

*Attesting Officer*

Q. TODD DICKINSON

*Commissioner of Patents and Trademarks*